US011760111B2

(12) United States Patent
Aizawa et al.

(10) Patent No.: US 11,760,111 B2
(45) Date of Patent: Sep. 19, 2023

(54) PRINTING APPARATUS AND PRINTING METHOD

(71) Applicant: Seiko Epson Corporation, Tokyo (JP)

(72) Inventors: Tadashi Aizawa, Matsumoto (JP); Hiroto Tomioka, Chino (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 17/655,666

(22) Filed: Mar. 21, 2022

(65) Prior Publication Data

US 2022/0305809 A1 Sep. 29, 2022

(30) Foreign Application Priority Data

Mar. 24, 2021 (JP) ..... 2021-049610

(51) Int. Cl.
*B41J 11/00* (2006.01)
*B41J 3/407* (2006.01)

(52) U.S. Cl.
CPC ..... *B41J 11/002* (2013.01); *B41J 3/4078* (2013.01)

(58) Field of Classification Search
CPC .... B41J 11/002; B41J 3/4078; B41J 11/0022; B41J 11/0021; B41J 2/01; B41J 11/0015; B41J 11/0024
See application file for complete search history.

(56) References Cited

U.S. PATENT DOCUMENTS

2003/0069329 A1* 4/2003 Kubota ..... B41J 11/0015 523/160

FOREIGN PATENT DOCUMENTS

JP 2017-114001 6/2017

* cited by examiner

*Primary Examiner* — Bradley W Thies
(74) *Attorney, Agent, or Firm* — WORKMAN NYDEGGER

(57) ABSTRACT

A printing apparatus 1 includes a pretreatment unit 4 that applies a processing liquid containing a polar material to a fabric M, a printing unit 5 that applies ink containing a color material to the fabric M applied with the processing liquid, and an AC electric field generator 62 that generates an AC electric field. The AC electric field generator 62 includes a first electrodes 71 and a second electrode 72 that face the fabric M and that are disposed adjacent to each other, a high-frequency voltage generator 77 that generates a high-frequency voltage to be applied to the first electrodes 71 and the second electrode 72, and a conductors 73 that electrically connects the first electrodes 71 and the second electrode 72 to the high-frequency voltage generator 77.

5 Claims, 7 Drawing Sheets

PRINTING APPARATUS AND PRINTING METHOD

The present application is based on, and claims priority from JP Application Serial Number 2021-049610, filed Mar. 24, 2021, the disclosure of which is hereby incorporated by reference herein in its entirety.

BACKGROUND

1. Technical Field

The disclosure relates to a printing apparatus and a printing method.

2. Related Art

As a drying apparatus for heating and drying a liquid discharged onto a medium, JP-A-2017-114001 discloses a configuration in which an electrode for dielectric heating is provided below the medium and a plurality of hot air fans are provided above the medium.

SUMMARY

When dielectric heating is performed on ink printed on a fabric or the like, it becomes an issue to continue heating at a temperature higher than the boiling point of water.

A printing apparatus includes a processing unit configured to apply a processing liquid containing a polar material to a fabric, a printing unit configured to apply ink containing a color material to the fabric applied with the processing liquid, a support portion configured to support the fabric downstream of the processing unit and the printing unit in a transport direction in which the fabric is transported, and an AC electric field generator configured to generate an AC electric field. The AC electric field generator includes a first electrode and a second electrode arranged adjacent to each other and arranged to face the fabric supported by the support portion, a high-frequency voltage generator configured to generate a high-frequency voltage to be applied to the first electrode and the second electrode, and a conductor that electrically connects the first electrode and the second electrode to the high-frequency voltage generator.

A printing method includes applying a processing liquid containing a polar material to a fabric, applying ink containing a color material to the fabric applied with the processing liquid, applying a high-frequency voltage to a first electrode and a second electrode that are arranged facing the fabric and that are arranged adjacent to each other, and causing the first electrode and the second electrode to generate an AC electric field by applying the high-frequency voltage to the first electrode and the second electrode.

DESCRIPTION OF EMBODIMENTS

Hereinafter, embodiments for implementing the disclosure will be described with reference to the drawings. However, in each of the drawings, the dimensions and scale of the respective portions are drawn different from the actual ones as appropriate. Further, although the embodiments described below are suitable specific examples, with various desirable technical limitations added, the scope of the disclosure is not limited to the embodiments in the following description unless otherwise specified to limit the disclosure.

EMBODIMENT

Figure 1:
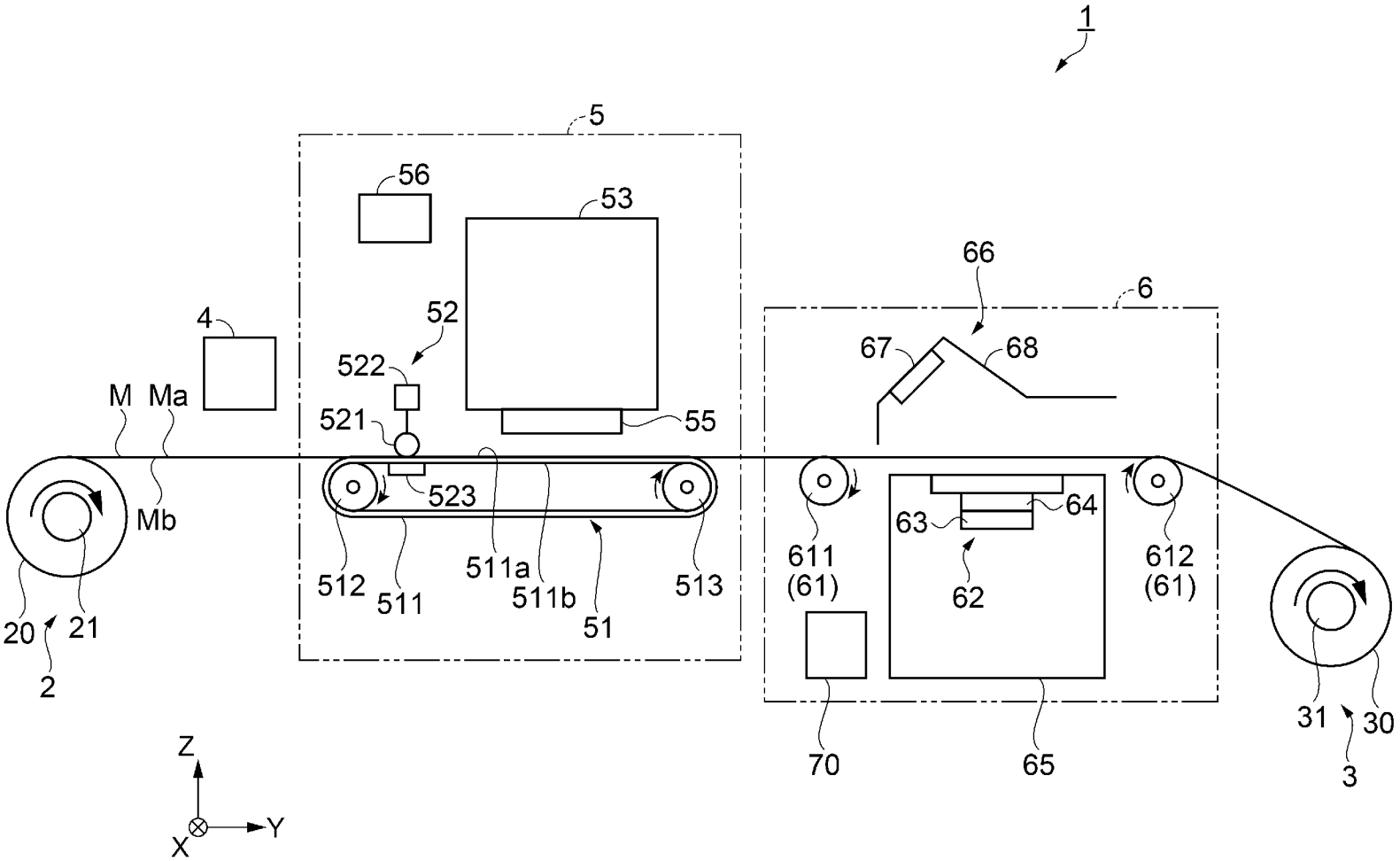
FIG. 1 is a schematic diagram illustrating a configuration of a printing apparatus according to an embodiment.

FIG. 1 is an explanatory view showing the configuration of a printing apparatus 1 according to the present embodiment.

The printing apparatus 1 according to the embodiment will be described with reference to FIG. 1.

The printing apparatus 1 includes a holding unit 2, a winding unit 3, a pretreatment unit 4 serving as a processing unit, a printing unit 5, and a drying unit 6.

In this embodiment, a fabric M is used as a medium printed on by the printing unit 5. Note that in the present embodiment, the fabric M includes cotton, silk, wool, chemical fiber, blended fabric, and the like.

The holding unit 2 is a configuration that holds a roll body 20 of rolled up fabric M, which is a sheet-like medium. The holding unit 2 includes a holding shaft 21 that holds the roll body 20. The holding shaft 21 is configured to be rotatable, for example. As the holding shaft 21 rotates, the fabric M is fed out from the roll body 20.

The winding unit 3 is a configuration that winds up the fabric M fed out from the holding unit 2. The winding unit 3 includes a winding shaft 31 which winds up the fabric M. The winding shaft 31 has a drive unit (not shown) for rotationally driving the winding shaft 31. The winding shaft 31 winds up the fabric M by being rotationally driven. As a result, the winding shaft 31 holds a roll body 30 formed by winding up the fabric M. In the present embodiment, the holding shaft 21 is rotationally driven so that the fabric M is fed out from the held roll body 20.

The fabric M is transported by being wound up on the winding unit 3. The fabric M is transported from the holding unit 2 toward the winding unit 3 via the pretreatment unit 4, the printing unit 5, and the drying unit 6 in this order. The transport direction of the fabric M is a direction from the holding unit 2 toward the winding unit 3. The fabric M has a surface Ma and a back surface Mb, which is the surface opposite from the surface Ma.

In the present embodiment, a direction from the holding unit 2 toward the winding unit 3, which is the transport direction, is defined as a +Y direction, and a direction opposite to the +Y direction is defined as a −Y direction. Further, the +Y direction and the −Y direction are collectively referred to as a Y axis. Further, a direction that intersects the Y axis and is the width direction of the fabric M is defined as an X axis, and the depth direction in FIG. 1 is defined as a +X direction. Further, a direction opposite to the +X direction is defined as a −X direction. A direction intersecting with the X-axis and the Y-axis is defined as a Z-axis, a height direction of the Z-axis is defined as a +Z-direction, and a direction opposite to the +Z-direction is defined as a −Z-direction.

The printing apparatus 1 is an ink jet printer that prints an image such as a character, a photograph, or a figure by ejecting ink as a liquid onto the fabric M. The printing unit 5 is a configuration that prints on the fabric M. The printing unit 5 is located between the pretreatment unit 4 and the drying unit 6 in the transport direction and is disposed upstream of the drying unit 6 in the transport direction.

The pretreatment unit 4 is disposed upstream of the printing unit 5 in the transport direction. The pretreatment unit is arranged linearly across the width of the fabric M. The pretreatment unit 4 applies a pretreatment liquid to the fabric M being transported. By performing the pretreatment, the permeability and fixing property of the ink discharged to the fabric M at the time of printing are enhanced, and print quality, such as color development of an image printed on the fabric M, is improved.

The pretreatment liquid is a processing liquid used in digital textile printing. In the present embodiment, the pretreatment liquid contains a polar material as a pretreatment material. In the present embodiment, urea, which is a component having a large dipole moment, is used as the polar material. Specifically, the pretreatment liquid is applied to the fabric M by making a foam from the pretreatment material and then rubbing the foam into the fabric M with a blade. When the pretreatment unit 4 applies the pretreatment liquid to the fabric M, the amount of water contained in the fabric M also increases.

The pretreatment material in the present embodiment includes urea, which is a component having a large dipole moment, as the polar material, but the polar material is not limited to urea. Other than urea as the component having a large dipole moment, ethylene glycol, ethanol, 2-propanol, 1-propanol, dimethyl sulfoxide, dimethylformamide, acetone, ethyl acetate, methanol, acetic acid, tetrahydrofuran, pyridine, dichloromethane, acetic anhydride, diethyl ether, trimethylamine, cyclohexane, xylene, hexane, benzene, toluene, n-pentane, ethylene urea and the like can be used. In addition, since the boiling point of water increases due to the bond between water and glycerin, glycerin can be used as a polar material. When urea is used as the polar material, the amount of urea applied to the fabric M is preferably 0.3 $g/m^2$ or more.

In the present embodiment, a polar material is also contained as a solvent of ink containing a color material when printing is performed. As the polar material contained in the ink, glycerin is used in the present embodiment. Similarly to the pretreatment material, it is also possible to use urea which is a component having a large dipole moment. By including glycerin, urea, and the like in the ink, the ink can be heated using an AC electric field to a temperature that equals or exceeds the boiling point of water. In addition to urea, a component having a large dipole moment as described above can be included as the solvent of the ink.

Next, a configuration of the printing unit 5 will be described.

The printing unit 5 includes a print support 51, a pressing unit 52, a carriage 53, a print head 55, and a controller 56. The controller 56 controls at least various components of the printing unit 5.

The print support 51 includes a support belt 511, a rotation roller 512, and a drive roller 513. The support belt 511 is formed of an endless rubber member or synthetic fiber wrapped around the rotation roller 512 and the drive roller 513. The rotation roller 512 is disposed upstream of the print head 55 in the transport direction and the drive roller 513 is disposed downstream of the print head 55 in the transport direction. The support belt 511 is held between the rotation roller 512 and the drive roller 513 in a state in which a predetermined tension is applied so that a region to be printed on the fabric M becomes horizontal.

As shown in FIG. 1, the outer peripheral surface of the support belt 511 is a support surface 511*a* that supports the fabric M. An adhesive is applied to the support surface 511*a* to provide an adhesive layer (not shown) to which the fabric M clings. The support belt 511 is configured as a so-called glue belt, with adhesive applied to the support surface 511*a*.

The support belt 511 supports and transports the fabric M that was pressed by the pressing unit 52 into intimate contact with the adhesive layer. By doing this, a stretchable fabric M can be treated as a printable medium.

The drive roller 513 includes a drive unit (not illustrated) for rotationally driving the drive roller 513. When the drive roller 513 is rotationally driven, the support belt 511 rotates along with the rotation and the rotation roller 512 rotates following the rotation of the support belt 511. Note that the driving unit that rotationally drives the drive roller 513 of the print support 51 and the driving unit that rotationally drives the winding shaft 31 of the winding unit 3 are controlled by the controller 56 to rotate so that the fabric M does not sag.

By drive of the drive roller 513, the support belt 511 transports the fabric M that is supported on the support surface 511*a* in the transport direction. The fabric M is transported in the transport direction by the support belt 511, and an image is printed on the fabric M by the carriage 53 and the print head 55 described later. By rotational drive of the winding shaft 31, the winding unit 3 separates the printed fabric M from the adhesive layer of the support belt 511 and transports the fabric M to the drying unit 6.

The pressing unit 52 presses the fabric M against the adhesive layer formed on the support belt 511 to bring the fabric M into intimate contact with the adhesive layer. The pressing unit 52 is provided upstream (−Y direction) of the print head 55 and downstream (+Y direction) of the rotation roller 512 in the movement direction (transport direction) of the support belt 511. The pressing unit 52 includes a pressing roller 521, a pressing roller drive 522, and a roller support 523.

The pressing roller 521 is formed in a cylindrical shape or a columnar shape, and is provided so as to be rotatable in a peripheral direction along the cylindrical surface of the pressing roller 521. The pressing roller 521 is disposed such that its roller shaft (not shown) extends in a width direction intersecting the transport direction so as to rotate in a direction along the transport direction. The roller support 523 is provided at the inner circumferential surface 511*b* side of the support belt 511 facing the pressing roller 521 with the support belt 511 interposed therebetween.

The pressing roller drive 522 presses the pressing roller 521 downward (in the −Z direction). The pressed pressing roller 521 rotates following the movement of the support belt 511 in the transport direction. The fabric M overlapping the support belt 511 is pressed against the support belt 511 between the pressing roller 521 and the roller support 523. By the operation of the pressing unit 52, the fabric M can be adhered to the adhesive layer formed on the support surface 511*a* of the support belt 511 and generation of the fabric M lifting up from the support belt 511 can be suppressed.

The print head 55 of the printing unit 5 faces the support belt 511. The print head 55 is positioned in the +Z direction of the support belt 511. The print head 55 is held by the carriage 53.

The print head 55 ejects ink containing a coloring material toward the fabric M supported on the support surface 511*a* (adhesive layer) of the support belt 511. As a result, an image is printed on the fabric M. In the present embodiment, the ink ejected by the print head 55 is a water-based ink that contains, in addition to water, glycerin serving as a polar material in the solvent. In this embodiment, a pigment ink using a pigment is used as the color material. Note that a dye ink using a dye as the color material may be used.

The carriage 53 is mounted with the print head 55. The carriage 53 faces the support belt 511. The carriage 53 is positioned in the +Z direction of the support belt 511. The carriage 53 reciprocates in directions along the X-axis with respect to the transported fabric M. That is, the carriage 53 reciprocates across the width direction of the fabric M from the +Z direction of the support belt 511.

The printing apparatus 1 is a serial printer that performs printing by the print head 55 reciprocally moving in the width direction with respect to the fabric M. Note that the printing apparatus 1 may be a line-type printer in which the print head 55 ejects liquid (ink) across the entire width direction of the fabric M at once.

The controller 56 controls each drive unit of the printing apparatus 1. The controller 56 includes a CPU, a memory, a control circuit, and an I/F (interface). The CPU is an arithmetic processing unit. The memory is a storage device that secures area for storing a program of the CPU, a work area, or the like, and includes a memory element such as an RAM, EEPROM. When recording data or the like is acquired via the I/F externally such as from an information processing terminal, the CPU controls driving units such as the carriage 53 and the print head 55 via the control circuit.

The controller 56 can communicate with the holding unit 2, the winding unit 3, and the drying unit 6, which will be described later. The controller 56 transmits and receives signals to and from the holding unit 2, the winding unit 3, and the drying unit 6 as necessary.

Next, the configuration of the drying unit 6 will be described.

The drying unit 6 is a configuration that heats and dries the fabric M that is transported after printing ends. The drying unit 6 is disposed downstream of the printing unit 5 in the transport direction and heats the fabric M to which the ink was applied by the printing unit 5. As shown in FIG. 1, the drying unit 6 includes a drying support 61 serving as a support, an AC electric field generator 62, a second blower 66 serving as a blower, and a controller 70.

The drying support 61 supports the fabric M transported after printing is completed. In the present embodiment, a pair of transport rollers 611 and 612 are provided. Each of the transport rollers 611 and 612 extends in a direction along the X-axis. One transport roller 611 is disposed upstream in the transport direction with respect to the other transport roller 612. The transport rollers 611 and 612 support the back surface Mb of the fabric M. Each of the transport rollers 611 and 612 is a driven roller driven to rotate in association with the winding operation of the fabric M by the winding unit 3.

The AC electric field generator 62 is a configuration that heats and dries the fabric M. Specifically, the AC electric field generator 62 generates an AC electric field with respect to the fabric M supported by the drying support 61 so as to heat the pretreatment liquid and the ink applied to the fabric M and dry the fabric M.

The AC electric field generator 62 is disposed between the transport roller 611 and the transport roller 612 in the transport direction. The AC electric field generator 62 is disposed at the back surface Mb side of the fabric M being transported. Therefore, the AC electric field generator 62 performs dielectric heating on the fabric M from the back surface Mb side of the fabric M.

The AC electric field generator 62 heats the liquid by generating an AC electric field of 2.4 GHz. Note that, for example, Joule's heat due to eddy currents generated in the liquid applied to the medium M by generating an AC electric field of 3 MHz to 300 MHz may be used, or dielectric heating due to frictional heat of molecular vibration by generating an AC electric field of 300 MHz to 30 GHz may be used. Among these, it is preferable to generate an AC electric field of 10 MHz to 20 GHz.

Figure 2:
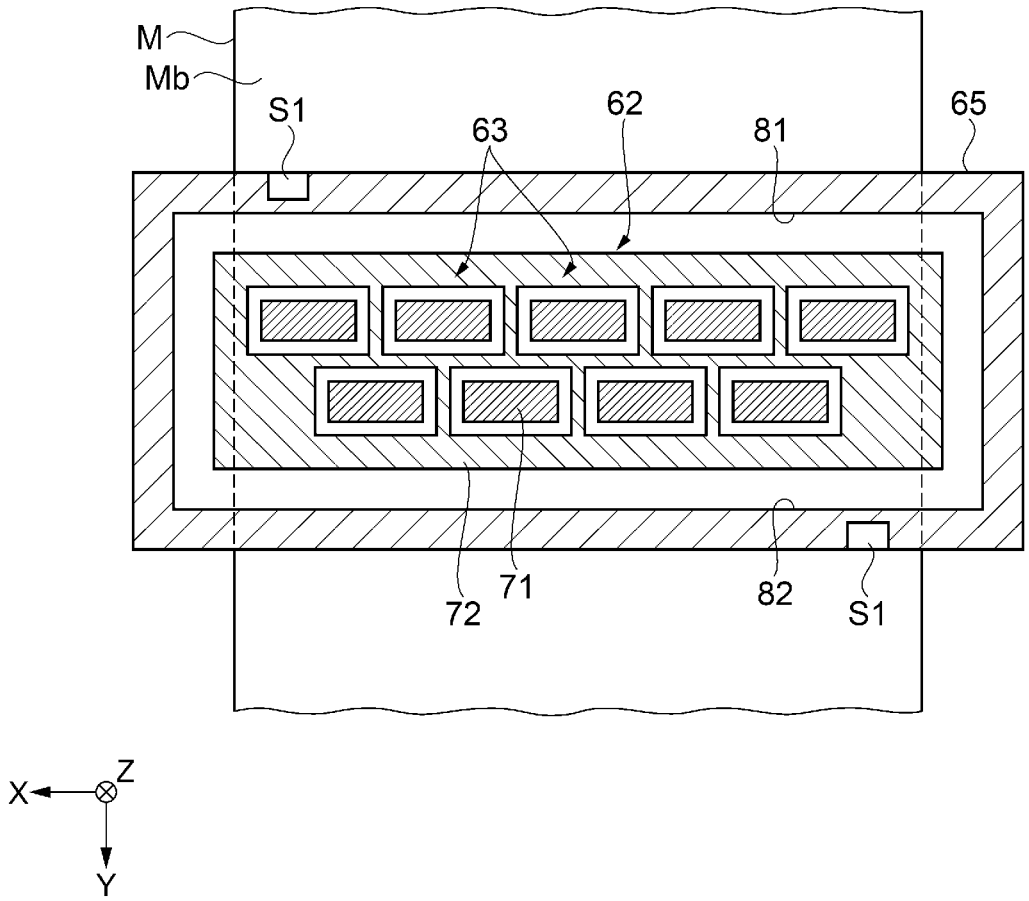
FIG. 2 is a schematic view showing configuration of an AC electric field generator.

FIG. 2 is a schematic diagram showing configuration of the AC electric field generator 62. FIG. 2 is a schematic view of the AC electric field generator 62 when viewed from the −Z direction.

As shown in FIG. 2, the AC electric field generator 62 has a plurality of generators 63 for generating an AC electric field. The plurality of generators 63 are arranged extending in the direction along the X-axis. The dimension of the plurality of generators 63 in the direction along the X-axis is set to be longer than the dimension of the fabric M in the direction along the X-axis. The plurality of generators 63 form a plurality of rows in the direction along the X-axis.

Specifically, in the generators 63 of the present embodiment, with respect to an upstream side in the transport direction, five first electrodes 71, which will be described later, are arranged in a row in a direction along the X-axis perpendicular to the transport direction and at a predetermined distance from a second electrode 72. Further, downstream in the transport direction with respect to the five generators 63 installed upstream in the transport direction, four generators 63 are arranged in the direction along the X-axis so that their first electrodes 71 are located in regions separated from the first electrodes 71 of the upstream five generators 63. Accordingly, the generators 63 are in two rows in which the first electrodes 71 are alternately arranged in the direction along the X-axis. As a result, the generators 63 can generate an AC electric field with respect to the transported fabric M, without gaps in the direction along the X-axis, which is the width direction.

Note that the number and arrangement of the generators 63 are not limited to those in the present embodiment as long as the generators 63 do not interfere with each other in the direction along the X-axis, which is the width direction, and an AC electric field can be generated without gaps with respect to the fabric M.

The plurality of generators 63 are disposed in a housing 65. The housing 65 is a box body opened in the +Z direction. The plurality of generators 63 are disposed facing the opening of the housing 65 so as to face the back surface Mb of the fabric M supported by the drying support 61.

It is preferable that the space in the direction along the Z-axis between the +Z direction end of the housing 65 and the fabric M is about 1 mm to 20 mm. This makes it possible to suppress a user's finger or the like from entering between the housing 65 and the fabric M.

An electric field detection sensor S1 is mounted on the housing 65. In the present embodiment, the electric field detection sensor S1 is configured to include a pair of electric field detection antennas that detect an AC electric field. The electric field detection sensor S1 faces the fabric M in the direction along the Z-axis. The electric field detection sensor S1 is disposed at an end portion of the housing 65. Specifically, one of the pair of electric field detection antennas is disposed in the vicinity of a corner portion of the housing 65, and the other electric field detection antenna is disposed in the vicinity of a corner diagonal to the position of the housing 65 where the one electric field antenna is located. In this manner, the electric field detection sensor S1 is disposed such that the electric field detection antennas are at positions separated from the generators 63, and can detect a change in the AC electric field generated from the AC electric field generator 62.

Figure 3:
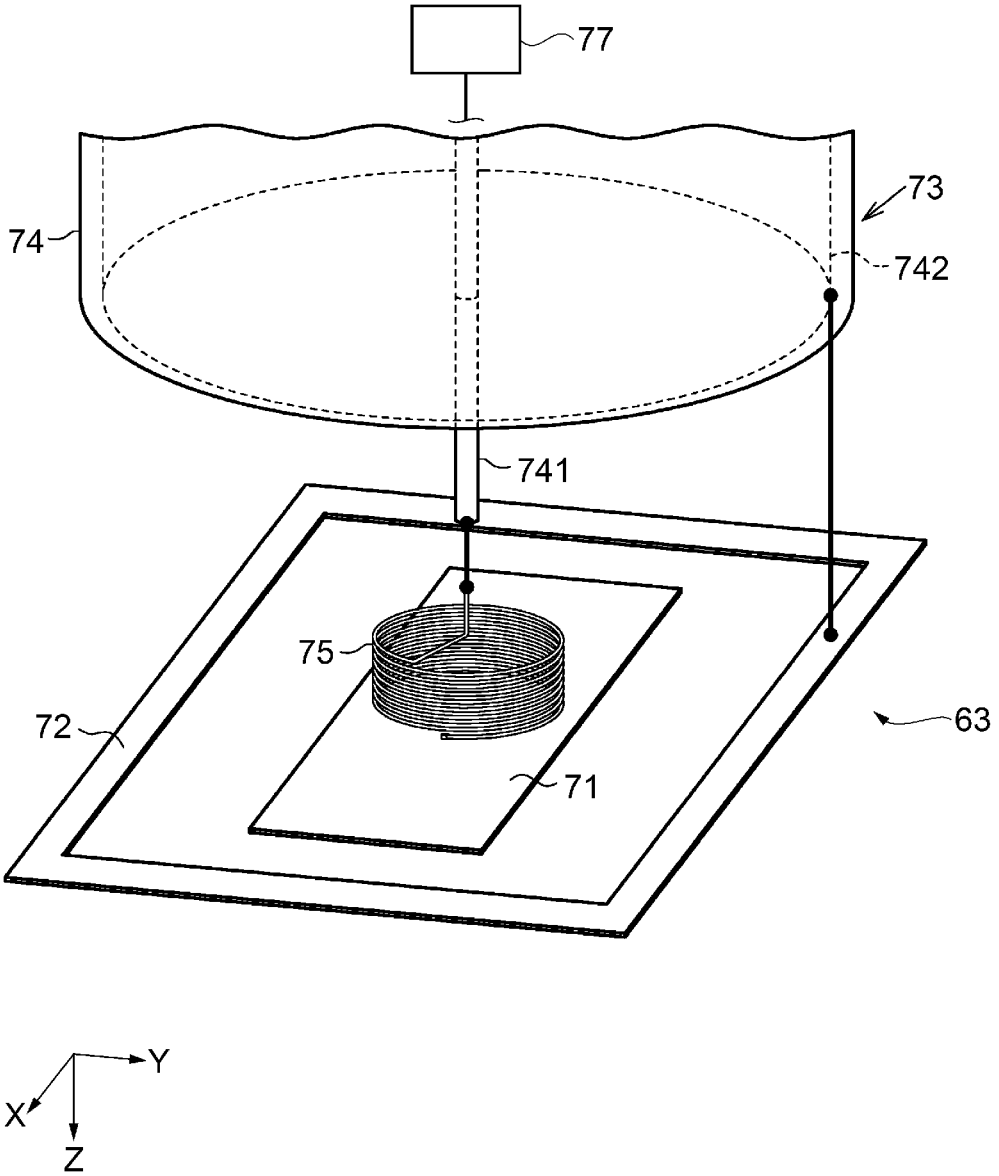
FIG. 3 is a schematic view showing configuration of the AC electric field generator.

FIG. 3 is a schematic diagram showing configuration of the AC electric field generator 62. FIG. 3 shows a configuration of one generator 63 portion separated out from the AC electric field generator 62, and is a schematic view when viewed from the −Z direction.

As shown in FIG. 3, the generator 63 has a first electrode 71, a second electrode 72, and a conductor 73. The first electrode 71 is a rectangular flat plate in a plan view from the −Z direction. The first electrode 71 faces the back surface Mb of the fabric M supported by the drying support 61. The first electrode 71 is disposed in the −Z direction of the fabric M.

The second electrode 72 is, in a plan view in the −Z direction, a hollow rectangular flat plate that surrounds the first electrode 71. The second electrode 72 faces the back surface Mb of the fabric M supported by the drying support 61. The second electrode 72 is disposed in the −Z direction of the fabric M. The first electrode 71 and the second electrode 72 are basically arranged adjacent to each other. In the present embodiment, as shown in FIG. 2, the second electrode 72 is configured as one electrode structure that is a common second electrode 72 for all the generators 63.

The conductor 73 electrically connects the first electrode 71 and the second electrode 72 to a high-frequency voltage generator 77 that generates a high-frequency voltage. The conductor 73 includes a coaxial cable 74 and a coil 75. The coaxial cable 74 includes an inner conductor 741 and an external conductor 742. The inner conductor 741 is connected to the first electrode 71 through the coil 75, and electrically connects the high-frequency voltage generator 77 and the first electrode 71. The external conductor 742 is connected to the second electrode 72, and electrically connects the high-frequency voltage generator 77 and the second electrode 72. The coil 75 as an example of a winding is connected between the first electrode 71 and the inner conductor 741 of the coaxial cable 74, and is preferably disposed at a position as close as possible to the first electrode 71.

The minimum separation distance between the first electrode 71 and the second electrode 72 is 1/10 or less of the wavelength of the AC electric field output from the AC electric field generator 62. Further, the first electrode 71 and the second electrode 72 have point-symmetrical shapes with respect to the center of the first electrode 71. Thus, since the electric field generated between the first electrode 71 and the second electrode 72 cancels the electric field generated at the point symmetrical position, most of the AC electric field generated when the high-frequency voltage is applied can be attenuated in the vicinity of the first electrode 71 and the second electrode 72. This can reduce the intensity of electromagnetic waves that reach a distance from the first electrode 71 and the second electrode 72. That is, the AC electric field generated by the AC electric field generator 62 is very strong in the vicinity of the first electrode 71 and the second electrode 72, and becomes very weak from far away.

By appropriately controlling the band of frequencies of the AC electric field to be generated, such a generator 63 can generate an AC electric field intensively in a range close to the first electrode 71 and the second electrode 72, for example, in a range of the 3 mm to 3 cm, and reduce the likelihood of the AC electric field influencing beyond this range.

In addition, in the generator 63, since it is possible to concentrate the AC electric field in the vicinity of the first electrode 71 and the second electrode 72, it is possible to improve the efficiency of heating the ink discharged onto the fabric M supported by the drying support 61 and to improve the efficiency of drying the fabric M. On the other hand, it is possible to make it difficult to generate an AC electric field at a position separated from the first electrode 71 and the second electrode 72, it is not necessary to excessively dispose a member for suppressing the AC electric field, and it is possible to improve workability of the drying unit 6. Further, it is possible to suppress an increase in size of the drying unit 6.

As shown in FIG. 1, in the generators 63, the facing surfaces of the first electrodes 71 and the second electrode 72 facing the fabric M are covered with a cover 64. In other words, the cover 64 covers the first electrodes 71 and the second electrode 72. The cover 64 is disposed in the +Z direction of the generators 63. Therefore, the first electrodes 71, the second electrode 72, and the cover 64 are disposed so as to face the back surface Mb, which is the opposite surface from the surface Ma to which the ink is applied. Since the generators 63 are covered by the cover 64, adhesion of foreign matter to the first electrodes 71, the second electrode 72, and the like is suppressed. In addition, even when the ink ejected from the print head 55 is atomized, adhesion of the ink to the first electrodes 71, the second electrode 72, and the like is suppressed.

The cover 64 is formed of a material that transmits an AC electric field generated from the AC electric field generator 62. Specifically, the cover 64 is formed of glass. Note that this is not a limitation and the cover 64 may be made of a resin with transmissivity, such as a cyclic olefin copolymer, and is preferably made of a material that is not easily affected by dielectric heating. In other words, the cover 64 may be made of an insulating material with a relatively small radio wave loss. The surface of the cover 64 on the +Z direction side has a rough shape, and the AC electric field generated from the AC electric field generator 62 can be converged toward the fabric M supported by the drying support 61.

In addition, the drying unit 6 includes an adjustment mechanism 78 (see FIG. 4) that enables the generators 63 and the cover 64 to move in directions along the Z axis. Thus, the distance between the generators 63 and the fabric M can be adjusted. The adjustment mechanism 78 may be, for example, a link mechanism or a rack and pinion mechanism. For this reason, the distance between the generators 63 and the fabric M can be easily adjusted according to the type of fabric M, the type of ink ejected from the print head 55, or the like.

Figure 4:
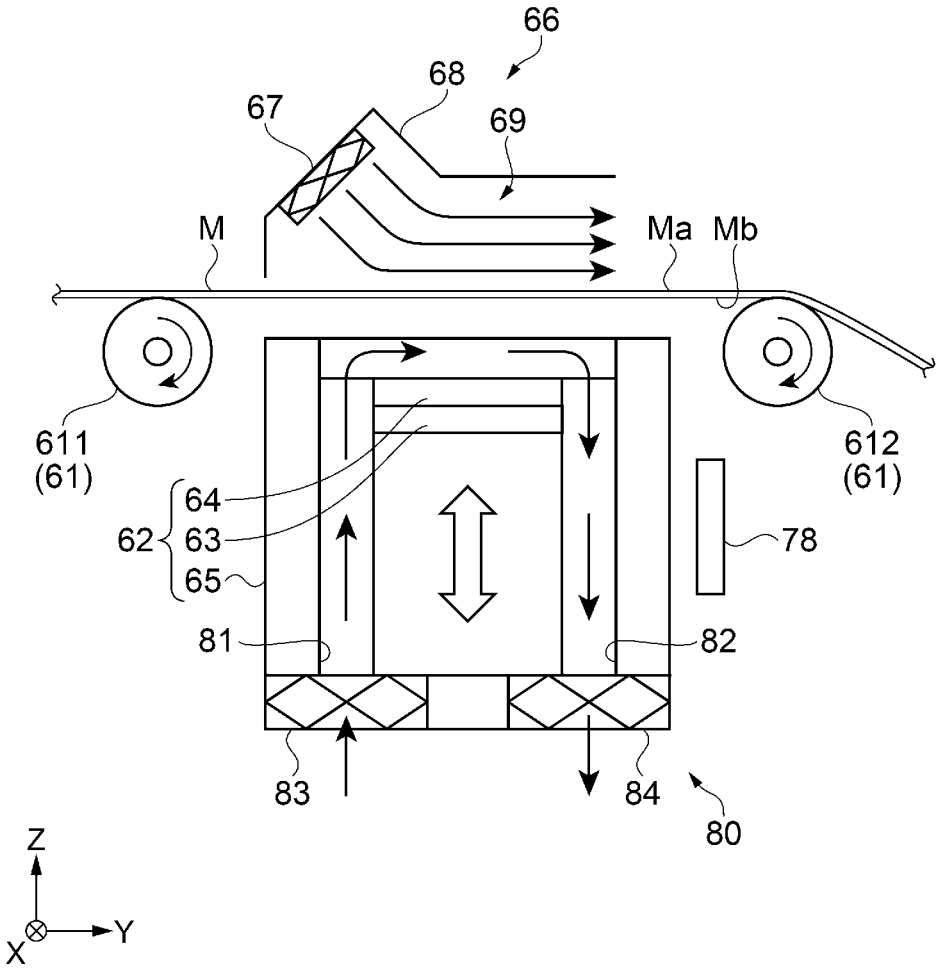
FIG. 4 is a schematic diagram showing configuration of a first blower and a second blower.

FIG. 4 is a schematic view showing configurations of a first blower 80 and the second blower 66.

As shown in FIG. 4, the drying unit 6 includes a first blower 80 that blows air at the generators 63 (the first electrodes 71 and the second electrode 72). The first blower 80 is mounted on the housing 65. The first blower 80 includes a first passage 81, a second passage 82, first blower fans 83, and second blower fans 84.

The first passage 81 is a passage extending in between the generators 63 and the −Y-direction side outer edge of the housing 65 in a direction along the Z-axis so as to be adjacent to the generators 63. The second passage 82 is a passage extending in between the generators 63 and the +Y-direction side outer edge of the housing 65 in a direction along the Z-axis so as to be adjacent to the generators 63.

A plurality of first blower fans 83 are arranged in a direction along the X axis at the −Z direction end of the first passage 81. The first blower fans 83 are fans that blow air from outside of the housing 65 into the first passage 81. A plurality of second blower fans 84 are arranged in a direction along the X-axis at the −Z direction end of the second passage 82. The second blower fans 84 are fans that blow air from the second passage 82 out of the housing 65.

Air is taken in from outside the housing 65 and blown through the first passage 81 by drive of the first blower fans 83, and blown from the second passage 82 out of the housing 65 by drive of the second blower fans 84. As a result, air flows from the first passage 81 through the +Z direction side of the cover 64 and through the second passage 82. In this manner, the first blower 80 blows air to the generators 63, including the coils 75, the first electrodes 71, and the second electrode 72. Thus, the generators 63, including the coils 75, the first electrodes 71, and the second electrode 72, are cooled. Further, the gas blown from the first blower fans 83 is heated by the generators 63. The heated gas is blown to the fabric M supported by the drying support 61, specifically, to the back surface Mb of the fabric M. As a result, the fabric M and the ink applied to the fabric M are warmed, and drying of the ink can be promoted.

As shown in FIG. 4, the drying unit 6 includes the second blower 66 that blows air at the fabric M being transported. The second blower 66 is disposed in the +Z direction of the fabric M so as to face the AC electric field generator 62 with the fabric M interposed therebetween. The dimension of the second blower 66 in the direction along the X axis is set to be substantially the same as the width dimension of the fabric M. The second blower 66 includes blower fans 67 and a flow passage case 68 for holding the blower fans 67.

The flow passage case 68 holds the blower fans 67 upstream in the transport direction. In the flow passage case 68, a flow passage 69 is configured so as to blow air blown from the blower fans 67 toward the fabric M being transported. The plurality of blower fans 67 are provided in the direction along the X-axis.

Air is taken from outside the flow passage case 68 into the flow passage case 68 by driving the blower fans 67. The air taken into the flow passage case 68 flows along the flow passage 69 and is blown toward the fabric M being transported. Specifically, air is blown toward the surface Ma of the fabric M on which the ink is applied. The air blown toward the fabric M is then blown downstream in the transport direction (+Y direction) outside the flow passage case 68.

When the fabric M is heated by the AC electric field generator 62, moisture in the pretreatment material and the ink evaporates by being heated, and water vapor is generated from the surface Ma of the fabric M to which the ink was applied. Therefore, by driving the second blower 66 to blow air toward the surface Ma of the fabric M, the generated water vapor is blown out or blown away to the outside of the second blower 66, so that drying of the ink can be promoted.

In the present embodiment, a high-frequency voltage is applied to the first electrodes 71 and the second electrode 72 by the high-frequency voltage generator 77, and the first electrodes 71 and the second electrode 72 generate an AC electric field to perform dielectric heating on the fabric M. In this case, urea which is a polar material is included as the pretreatment material. The ink also contains glycerin, a polar material, as a solvent for the ink. In this way, by using glycerin as the polar material, when dielectric heating is performed in the drying unit 6, heating can be continued at a temperature equal to or higher than the boiling point of water (100° C.)

In the present embodiment, by using urea, heating can be continued at a temperature of about 150° C. to 160° C., for example. Further, when a component having a dipole moment larger than that of water is used, the heating efficiency can be remarkably improved as compared with water. Note that other than urea, including the above-described components having a large dipole moment as a polar material in the pretreatment material or the ink as a solvent enables continuous heating at a temperature equal to or higher than the boiling point of water.

In this way, in the dielectric heating of the present embodiment, heating is continued at a temperature equal to or higher than the boiling point of water to heat the pretreatment material or the ink, and resin particles contained in the ink are melted into the fabric. By the molten resin holding pigment, the pigment can be fixed to the material of the fabric M. This can improve not only the fixability of the ink but also the scratch resistance.

Figure 5:
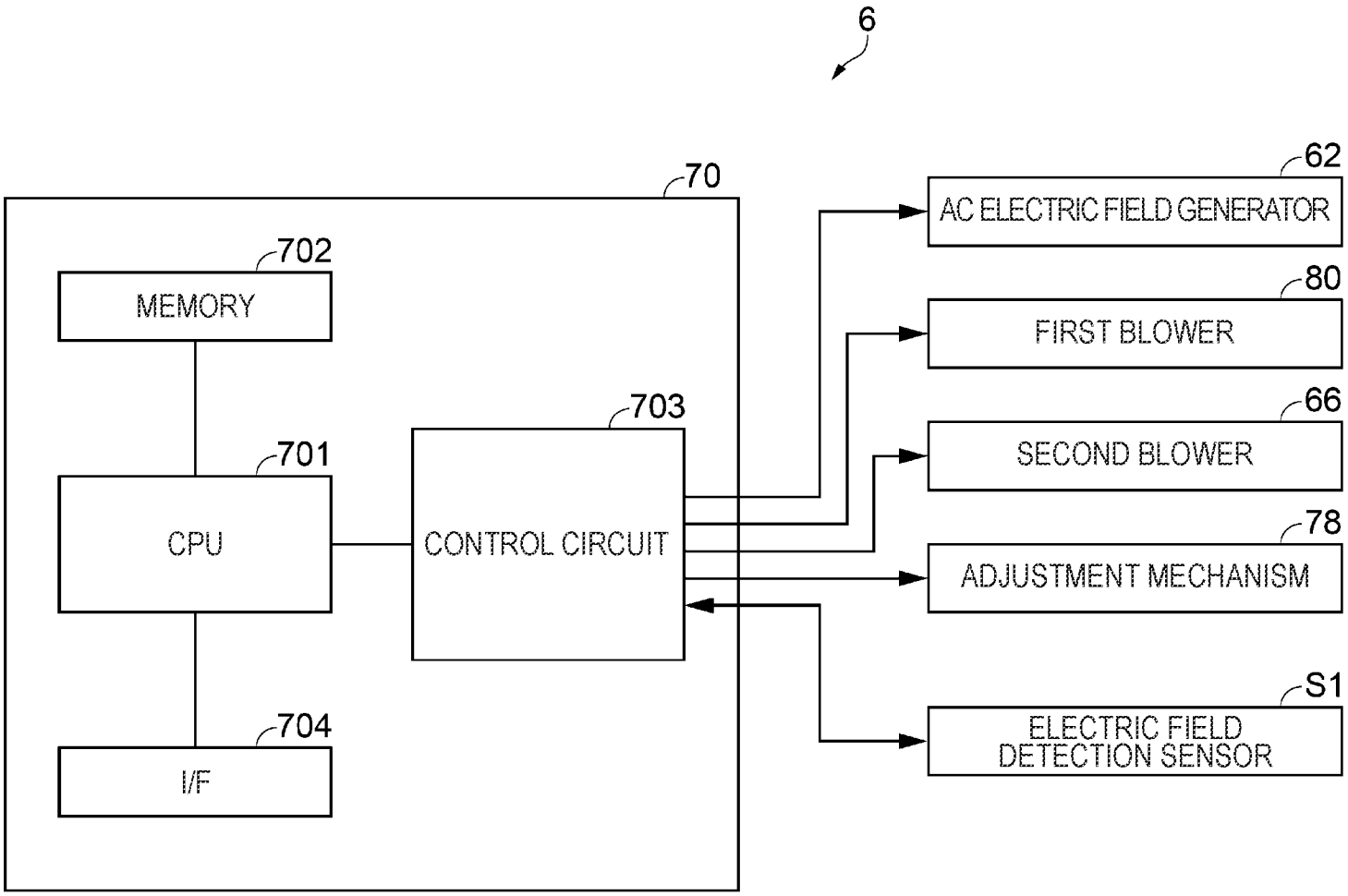
FIG. 5 is a block diagram showing configuration of a controller of a drying unit.

FIG. 5 is a block diagram showing the configuration of the controller 70 of the drying unit 6.

Configuration of the controller 70 of the drying unit 6 will be described.

The controller 70 controls each driving unit of the drying unit 6. The controller 70 includes a CPU 701, a memory 702, a control circuit 703, and an I/F (interface) 704. The CPU 701 is an arithmetic processing unit. The memory 702 is a storage device that secures area for storing a program of the CPU 701, a work area, or the like, and includes a memory element such as an RAM and an EEPROM.

When drying process data or the like is acquired externally of the data processing terminal or the like via the I/F 704, the CPU 701 controls, via the control circuit 703, the AC electric field generator 62, the first blower 80, the second blower 66, the adjustment mechanism 78, and the electric field detection sensor S1. The controller 70 can control the holding unit 2, the winding unit 3, and the pretreatment unit 4 in cooperation with the printing unit 5 side controller 56. The controller 70 controls drive of the AC electric field generator 62 based on a signal from the electric field detection sensor S1.

Note that in addition to the electric field detection sensor S1, an optical sensor (not shown) or the like may be mounted on the outer peripheral surface of the housing 65 of the drying unit 6 or the outer peripheral surface of the flow passage case 68 so as to face the fabric M, so that the controller 70 may detect that a user's finger or the like enters between the housing 65 or the flow passage case 68.

Figure 6:
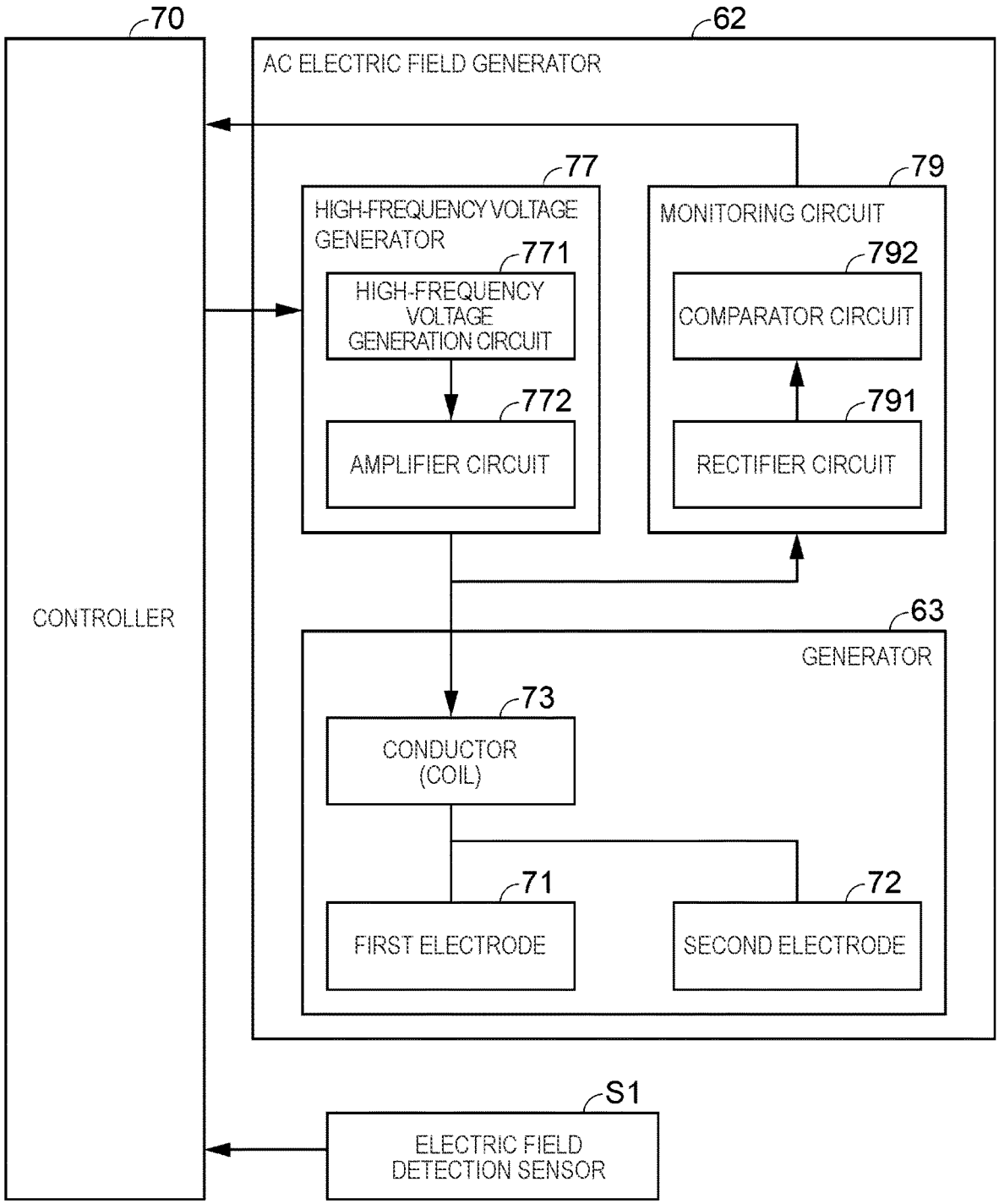
FIG. 6 is a block diagram showing configuration of the AC electric field generator of the drying unit.

FIG. 6 is a block diagram showing the configuration of the AC electric field generator 62 of the drying unit 6.

Configuration of the AC electric field generator 62 of the drying unit 6 will be described.

The AC electric field generator 62 includes a monitoring circuit 79 in addition to the generators 63 and the high-frequency voltage generator 77. The high-frequency voltage generator 77 is connected to the generators 63. Specifically, the high-frequency voltage generator 77 is connected to the first electrodes 71 and the second electrode 72 via the conductors 73. The high-frequency voltage generator 77 generates a high-frequency voltage to be applied to the first electrodes 71 and the second electrode 72 and generates an AC electric field from the first electrodes 71 and the second electrode 72 by outputting the high-frequency voltage to the first electrodes 71 and the second electrode 72.

The high-frequency voltage generator 77 includes a high-frequency voltage generation circuit 771 and an amplifier circuit 772. The high-frequency voltage generation circuit 771 is connected to the controller 70 and the amplifier circuit 772. The high-frequency voltage generation circuit 771 generates a high-frequency voltage on the basis of a generation instruction signal from the controller 70 and outputs the high-frequency voltage to the amplifier circuit 772. The amplifier circuit 772 is a circuit that amplifies the high-frequency voltage that was generated by the high-frequency voltage generation circuit 771 based on the generation instruction signal from the controller 70 and outputs the amplified high-frequency voltage to the generators 63. The high-frequency voltage generator 77 may supply power of 3 kW or less to the generators 63, for example.

Note that in a related art drying apparatus that uses a heating wire, for example, 18 kW power is used to heat air with the heating wire, and the heated air is blown onto the fabric surface to dry the ink. Compared with such a drying apparatus, the printing apparatus 1 of the present embodiment uses dielectric heating, thereby greatly reducing the amount of energy used.

The monitoring circuit 79 is connected to the high-frequency voltage generator 77 and the controller 70. The monitoring circuit 79 monitors the high-frequency voltage from the high-frequency voltage generator 77 and outputs the result of monitoring the high-frequency voltage to the controller 70.

The monitoring circuit 79 includes a rectifier circuit 791 and a comparator circuit 792. The rectifier circuit 791 is connected to the high-frequency voltage generator 77 and the comparator circuit 792. The rectifier circuit 791 rectifies and smooths the high-frequency voltage from the high-frequency voltage generator 77 to convert it into a direct current, and outputs the direct current to the comparator circuit 792.

The comparator circuit 792 is connected to the rectifier circuit 791 and the controller 70. The comparator circuit 792 compares the signal output from the rectifier circuit 791 with a reference voltage and, when the signal output from the rectifier circuit 791 exceeds the reference voltage, outputs a signal to the controller 70 indicating that the reference voltage has been exceeded.

The monitoring circuit 79 monitors the high-frequency voltage input to the generators 63 by utilizing the property that the electric resistance, that is, the impedance, of the coils 75 changes due to abnormal heat generation of the coils 75. Therefore, when the high-frequency voltage exceeds the reference voltage, the monitoring circuit 79 presumes that the temperature of the coils 75 has increased, and detects that abnormal heat generation relating to the generators 63 has occurred. In particular, the temperature of the generators 63 may rise due to the heat generation of the coils 75, and if the temperature fluctuation of the coils 75 can be grasped, the abnormal heat generation of the generators 63 can be detected. Specifically, the coils 75 are made of copper. The electrical resistance of copper changes greatly in accordance with temperature changes, and a temperature rise of about 50° C. can be detected even with a simple circuit.

In the monitoring circuit 79, a diode for rectification and a capacitor for smoothing are used in the rectifier circuit 791, and a Zener diode for generating a reference voltage is used in the comparator circuit 792. Further, even when the frequency of the AC electric field generated by the generators 63 changes due to aging or the like, the monitoring circuit 79 can detect that an abnormality related to the generators 63 has occurred from change in the electric resistance of the generators 63, especially the electric resistance of the coils 75. The monitoring circuit 79 detects a change in the impedance of the generators 63 including the conductors 73, the first electrodes 71, and the second electrode 72 and, on the basis of the detected change, detects the temperature of at least one of the conductors 73, the first electrodes 71, or the second electrode 72.

When a condition as a defect is established when printing is started, the controller 70 stops the start of printing. The controller 70 stops printing when a condition as a failure is established when printing is started and printing is in progress. As a result, it is possible to avoid failure of the AC electric field generator 62.

Figure 7:
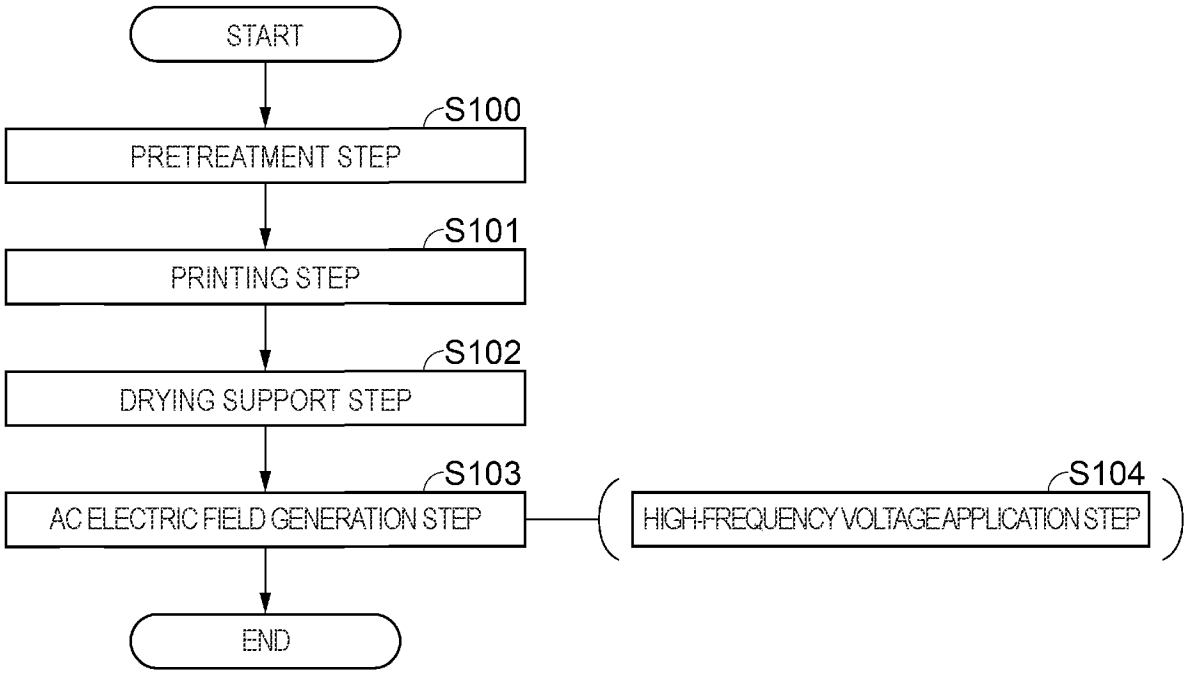
FIG. 7 is a flowchart illustrating a printing method of the printing apparatus.

FIG. 7 is a flowchart showing a printing method of the printing apparatus 1.

Referring to FIG. 7, the printing method of the printing apparatus 1 according to the embodiment will be described.

Note that because the printing method in the printing apparatus 1 of the present embodiment includes the same contents as the configuration and operation of the printing apparatus 1 described above, the series of processes will be described below in a simplified manner.

First, in a pretreatment step (step S100) serving as a processing step, a processing liquid containing a polar material is applied to the surface Ma of the fabric M fed out from the roll body 20 in the pretreatment unit 4 serving as a processing unit. Note that in the present embodiment, the processing liquid contains urea, which has a large dipole moment, serving as a polar material. Next, in a printing step (step S101), ink containing a coloring material is applied by the operation of the carriage 53 and the print head 55 to the surface Ma of the fabric M to which the processing liquid was applied. It should be noted that in this embodiment, the solvent of the ink also contains a polar material, more specifically, it contains glycerin as the polar material.

Next, in a drying support step (step S102) serving as a support step, the fabric M on which the pretreatment step and the printing step have been completed is supported by the drying support 61 serving as a support portion and transported across the AC electric field generator 62. Next, in an AC electric field generation step (step S103), an AC electric field is generated on the fabric M by the AC electric field generator 62 to heat and dry the applied pretreatment material and ink.

It should be noted that the AC electric field generation step (step S103) includes a high-frequency voltage application step (step S104). In the high-frequency voltage application step (step S104), a high-frequency voltage is applied by the high-frequency voltage generator 77 to the first electrodes 71 and the second electrode 72 that are disposed adjacent to each other and that face the fabric M supported by the drying support 61. By applying the high-frequency voltage to the first electrodes 71 and the second electrode 72, the first electrodes 71 and the second electrode 72 generate an AC electric field. The applied pretreatment material and ink is heated and dried by the AC electric field.

According to this embodiment, the following effects can be obtained.

In the printing apparatus 1 of the present embodiment, the pretreatment unit 4 serving as a processing unit applies a processing liquid containing a polar material to the fabric M.

In this embodiment, the processing liquid of this embodiment contains urea, which has a large dipole moment, as a polar material. Then, the printing unit 5 applies ink containing a color material to the fabric M to which the processing liquid was applied. Note that the solvent of the ink of the present embodiment contains glycerin as a polar material. Then, the fabric M supported by the drying support 61 serving as a support portion is subjected to dielectric heating by the AC electric field generator 62. Note that the AC electric field generator 62 includes the first electrodes 71, the second electrode 72, the high-frequency voltage generator 77, and the conductors 73. The high-frequency voltage generated by the high-frequency voltage generator 77 is applied to the first electrodes 71 and the second electrode 72 to generate an AC electric field and perform induction heating.

In this way, the processing liquid contains a polar material. Further, in this embodiment, a processing liquid containing urea, which is a component having a large dipole moment, is applied as a polar material and dielectric heating is performed. This makes it possible to continue heating at a temperature equal to or higher than the boiling point of water. Further, heating efficiency can be improved. Therefore, the fixing property of the ink to the fabric M can be improved, and scratch resistance can be improved. In this embodiment, the solvent of the ink also contains a polar material. In the present embodiment, the same effect can be obtained by including glycerin in the solvent of the ink as the polar material.

The printing apparatus 1 of this embodiment includes a cover 64 for covering the first electrodes 71 and the second electrode 72.

With this configuration, it is possible to prevent foreign matter from adhering to the AC electric field generator 62 such as to the first electrodes 71 and the second electrode 72. Further, even when the ink from the printing unit 5 is atomized, the ink is prevented from adhering to the AC electric field generator 62.

In the printing apparatus 1 of the present embodiment, the first electrodes 71, the second electrode 72, and the cover 64 are arranged to face the surface (back surface Mb) opposite to the surface (surface Ma) of the fabric M to which ink is applied.

With this configuration, dielectric heating can be performed from the side of the surface (back surface Mb) opposite to the surface (surface Ma) of the fabric M on which the ink is applied.

The printing apparatus 1 of the present embodiment includes the second blower 66 serving as a blower that blows air to the surface (surface Ma) to which ink was applied of the fabric M that is supported by the drying support 61.

With this configuration, the first electrodes 71, the second electrode 72, and the cover 64 are arranged to face a surface (back surface Mb) opposite to a surface (surface Ma) to which ink is applied, and perform dielectric heating from the side of the surface (back surface Mb) opposite to the surface (surface Ma) to which ink is applied. In this case, moisture in the ink is evaporated by dielectric heating, and water vapor is generated from the surface (surface Ma) to which the ink is applied. However, drying can be promoted by providing the second blower 66 and blowing off the generated water vapor by blowing air to the surface (surface Ma) to which the ink was applied.

In the printing method of this embodiment, a processing liquid containing a polar material is applied to the fabric M in a pretreatment step serving as a processing step. Note that the processing liquid contains urea, which has a large dipole moment, as a polar material. Then, in the printing step, ink containing a color material is applied to the fabric M to which the processing liquid was applied. The solvent of the ink contains glycerin as a polar material. In the drying support step serving as a support step, the fabric M after the pretreatment step and the printing step is supported. In the high-frequency voltage application step, dielectric heating is performed by generating an AC electric field on the fabric M supported in the drying support step. Note that the AC electric field generation step includes a high-frequency voltage application step. In the high-frequency voltage applying process, the high-frequency voltage generator 77 applies a high-frequency voltage to the first electrodes 71 and the second electrode 72. By this, the first electrodes 71 and the second electrode 72 generate an AC electric field by the applied high-frequency voltage. By this, induction heating is performed on the fabric M.

In this method, in the pretreatment step, the processing liquid contains a polar material. Further, in this embodiment, a processing liquid containing urea, which is a component having a large dipole moment, is applied as a polar material and dielectric heating is performed. This makes it possible to continue heating at a temperature equal to or higher than the boiling point of water. When a component having a dipole moment larger than that of water is used, the heating efficiency can be improved. Therefore, the fixing property of the ink to the fabric M can be improved, and scratch resistance can be improved. In this embodiment, the same effect can be obtained by including glycerin as the polar material in the solvent of the ink in the printing process.

What is claimed is:

1. A printing apparatus for printing on fabric, comprising:

a processing unit configured to apply a processing liquid containing a polar material to the fabric;

a printing unit configured to apply ink containing a color material to the fabric applied with the processing liquid;

a support portion configured to support the fabric downstream of the processing unit and the printing unit in a transport direction in which the fabric is transported; and an AC electric field generator that generates an AC electric field, wherein the AC electric field generator includes a first electrode and a second electrode arranged adjacent to each other and arranged to face the fabric supported by the support portion, a high-frequency voltage generator configured to generate a high-frequency voltage to be applied to the first electrode and the second electrode, and a conductor that electrically connects the first electrode and the second electrode to the high-frequency voltage generator.

2. The printing apparatus according to claim 1, further comprising:

a cover that covers the first electrode and the second electrode.

3. The printing apparatus according to claim 2, wherein the first electrode, the second electrode, and the cover are disposed facing a surface of the fabric opposite from a surface of the fabric applied with ink.

4. The printing apparatus according to claim 3, further comprising:

a blower configured to blow air to the surface applied with ink, of the fabric supported by the support portion.

5. A method for printing on fabric, comprising:

applying a processing liquid containing a polar material to the fabric;

applying ink containing a color material to the fabric applied with the processing liquid;

applying a high-frequency voltage to a first electrode and a second electrode that are arranged facing the fabric and that are arranged adjacent to each other; and causing the first electrode and the second electrode to generate an AC electric field by applying the high-frequency voltage to the first electrode and the second electrode.

* * * * *